US007686855B2

(12) United States Patent
Sills et al.

(10) Patent No.: US 7,686,855 B2
(45) Date of Patent: Mar. 30, 2010

(54) METHOD FOR TRANSPORTING SYNTHETIC PRODUCTS

(75) Inventors: Ronald Sills, Houston, TX (US); Theo H. Fleisch, Houston, TX (US); Taras Y. Makogon, Moscow (RU); Michael D. Briscoe, Katy, TX (US)

(73) Assignee: BP Corporation North America Inc., Warrenville, IL (US)

( * ) Notice: Subject to any disclaimer, the term of this patent is extended or adjusted under 35 U.S.C. 154(b) by 952 days.

(21) Appl. No.: 11/220,140

(22) Filed: Sep. 6, 2005

(65) Prior Publication Data

US 2006/0058564 A1 Mar. 16, 2006

Related U.S. Application Data

(60) Provisional application No. 60/607,837, filed on Sep. 8, 2004.

(51) Int. Cl.
*C10L 1/185* (2006.01)
*F17C 11/00* (2006.01)

(52) U.S. Cl. ..... 44/438; 62/46.1

(58) Field of Classification Search ..... 44/438; 62/46.1

See application file for complete search history.

(56) References Cited

U.S. PATENT DOCUMENTS

| | | | | |
|---|---|---|---|---|
| 3,326,956 | A | 6/1967 | Davies et al. | |
| 3,894,102 | A | 7/1975 | Chang et al. | |
| 3,894,106 | A | 7/1975 | Chang et al. | |
| 3,894,107 | A | 7/1975 | Butter et al. | |
| 3,928,483 | A | 12/1975 | Chang et al. | |
| 4,010,622 | A * | 3/1977 | Etter | 62/46.1 |
| 4,025,575 | A | 5/1977 | Chang et al. | |
| 4,075,251 | A | 2/1978 | Mertzweiller et al. | |
| 4,252,479 | A | 2/1981 | Scherfenberg | |
| 4,341,069 | A | 7/1982 | Bell et al. | |
| 4,417,000 | A | 11/1983 | Slaugh et al. | |
| 4,447,669 | A | 5/1984 | Hamon et al. | |
| 4,496,786 | A | 1/1985 | Santilli et al. | |
| 4,499,314 | A | 2/1985 | Seddon et al. | |
| 4,547,616 | A | 10/1985 | Avidan et al. | |
| 4,677,242 | A | 6/1987 | Kaiser | |
| 4,677,243 | A | 6/1987 | Kaiser | |
| 4,843,183 | A | 6/1989 | Inui | |
| 4,861,938 | A | 8/1989 | Lewis et al. | |
| 4,973,792 | A | 11/1990 | Lewis et al. | |
| 5,095,163 | A | 3/1992 | Barger | |
| 5,126,308 | A | 6/1992 | Barger et al. | |
| 5,177,114 | A | 1/1993 | Van Dijk et al. | |
| 5,218,003 | A | 6/1993 | Lewnard et al. | |
| 5,714,662 | A | 2/1998 | Vora | |
| 6,046,372 | A | 4/2000 | Brown et al. | |
| 6,085,528 | A | 7/2000 | Woodall et al. | |
| 6,203,631 | B1 | 3/2001 | Bowen et al. | |
| 6,248,794 | B1 | 6/2001 | Gieskes | |
| 6,270,541 | B1 | 8/2001 | Basu et al. | |
| 6,445,747 | B1 | 9/2002 | Jafarkhani et al. | |
| 6,449,961 | B1 * | 9/2002 | Korsgaard | 62/46.1 |
| 6,472,558 | B1 | 10/2002 | Key et al. | |
| 6,534,692 | B1 | 3/2003 | Barger et al. | |
| 6,632,971 | B2 | 10/2003 | Brown et al. | |
| 6,743,829 | B2 | 6/2004 | Fischer-Calderon et al. | |
| 6,743,962 | B2 | 6/2004 | O'Rear | |
| 6,774,148 | B2 | 8/2004 | O'Rear | |
| 6,784,330 | B2 | 8/2004 | Brown et al. | |
| 6,821,501 | B2 | 11/2004 | Matzakos et al. | |
| 2004/0074241 | A1 | 4/2004 | Bishop et al. | |
| 2004/0244279 | A1 * | 12/2004 | Briscoe et al. | 44/438 |

FOREIGN PATENT DOCUMENTS

| | | |
|---|---|---|
| EP | 0324475 | 7/1989 |
| EP | 0409086 | 1/1991 |
| WO | 9814362 | 4/1998 |

OTHER PUBLICATIONS

P.J. Openshaw & E.F. Rhodes, Gas Purification in the Dense Phase at the CATS Terminal, XIV Gas International Conference (Caracas, Venezuela (2000)).*

Pruitt, "Mineral Terms—Some Problems in Their Use and Definition," Rocky Mt. Min. L. Rev. 1, 16 (1966).

Openshaw et al., "Gas purification in the dense phase at the CATS terminal", XIV Gas International Conference (May 2000).

Cheng et al., Chapter 3—"Methanol Production and Use", Marcel Dekker, Inc. New York, NY (1994).

U.S. Appl. No. 10/805,943, filed Mar. 22, 2004.

U.S. Appl. No. 10/935,976, filed Sep. 8, 2004.

U.S. Appl. No. 10/805,982, filed Mar. 22, 2004.

* cited by examiner

*Primary Examiner*—Glenn Caldarola
*Assistant Examiner*—Randy Boyer
(74) *Attorney, Agent, or Firm*—John L. Wood

(57) ABSTRACT

Disclosed are methods for transporting one or more synthetic products produced from a carbonaceous source, such as coal, natural gas, or biomass, which may be located in a location that is remote from markets for such products. The synthetic products may include lower molecular weight alcohols such as methanol, lower molecular weight ethers such as dimethyl ether, olefins and/or the products of a Fischer-Tropsch or other hydrocarbon synthesis. The methods include transport of such synthetic products via a pipeline in the dense phase state, either neat or blended with light hydrocarbons, such as natural gas.

41 Claims, 3 Drawing Sheets

METHOD FOR TRANSPORTING SYNTHETIC PRODUCTS

CROSS REFERENCE TO RELATED APPLICATIONS

This application is entitled to and claims the benefit of U.S. Provisional Patent Application Ser. No. 60/607,837, filed Sep. 8, 2004, the teachings of which are incorporated herein by reference in their entirety.

FIELD OF THE INVENTION

The present invention relates to methods for transport of synthetic chemical products such as oxygenates and hydrocarbon compositions derived from natural gas, coal, or other carbonaceous feedstocks, and particularly to a method for pipeline transport of compositions comprising blends of such synthetic products and natural gas.

BACKGROUND OF THE INVENTION

Natural gas generally refers to rarefied or gaseous hydrocarbons (comprised of methane and light hydrocarbons such as ethane, propane, butane, and the like) which are found in the earth. Non-combustible gases occurring in the earth, such as carbon dioxide, helium and nitrogen are generally referred to by their proper chemical names. Often, however, non-combustible gases are found in combination with combustible gases and the mixture is referred to generally as "natural gas" without any attempt to distinguish between combustible and non-combustible gases. See Pruitt, "Mineral Terms-Some Problems in Their Use and Definition," Rocky Mt. Min. L. Rev. 1, 16 (1966).

Natural gas is often plentiful in remote locations or regions where it is uneconomical to develop those reserves due to lack of a local market for the gas or the high cost of processing and transporting the gas to distant markets. Such natural gas is accordingly referred to in the energy industry as "stranded gas" or "remote gas".

Recently a number of methods have been investigated and/or proposed to allow for more economic use of such resources by converting the stranded gas into products which are more readily transportable, such as methanol, dimethyl ether or other chemicals, as well as liquid hydrocarbons.

It is also commercially important to cryogenically liquefy natural gas so as to produce liquefied natural gas ("LNG") for more convenient storage and transport. A fundamental reason for the liquefaction of natural gas is that liquefaction results in a volume reduction of about 1/600, thereby making it possible to store and transport the liquefied gas in containers at low or even atmospheric pressure. Liquefaction of natural gas is of even greater importance in enabling the transport of gas from a supply source to market where the source and market are separated by great distances.

In order to store and transport natural gas in the liquid state, the natural gas is preferably cooled to extremely low cryogenic temperatures of from −240° F. (−151° C.) to −260° F. (−162° C.) where it may exist as a liquid at near atmospheric vapor pressure. Various methods and/or systems exist in the prior art for liquefying natural gas or the like whereby the gas is liquefied by sequentially passing the gas through a plurality of cooling stages, and cooling the gas to successively lower temperatures until liquefaction is achieved. Cooling is generally accomplished by heat exchange with one or more refrigerants such as propane, propylene, ethane, ethylene, nitrogen and methane, or mixtures thereof. The refrigerants are commonly arranged in a cascaded manner, in order of diminishing refrigerant boiling point. As appreciated by those skilled in the art, LNG plants are relatively expensive to build and operate. Further, the resulting LNG product must be transported in specially designed ships to maintain the LNG in liquid form for extended periods of time at such cryogenic temperatures until it reaches a market, where it then must be regasified in a specialized regasification facility.

Dimethyl ether can be manufactured from natural gas, coal and other carbonaceous feedstocks and is used in some markets as a fuel or fuel blendstock. See e.g., U.S. Pat. Nos. 4,341,069; 4,417,000; 5,218,003; and 6,270,541, and European Patent Publications 0 324 475 and 0 409 086, the teachings of which are incorporated herein by reference.

Many current or potential markets for dimethyl ether that is used as a fuel, such as in China, India, Japan, Europe, and Korea, are located significant distances from natural gas resources that could supply the demand for such fuel, such as inland natural gas fields in central Russia.

To economically supply markets for dimethyl ether where it is to be used as a multi-purpose fuel, the feedstock resource such as natural gas or coal generally needs to be located at or close to a coastal location so that the dimethyl ether produced with such feedstock can be economically transported to distant markets by ship. If the feedstock resource is located at for example a remote inland area; that is a significant distance from the coastal location, then transport options for dimethyl ether produced at such remote locations, such as by a dedicated pipeline, railroad car, or trucks, may make it uneconomical to transport the dimethyl ether into a relevant fuels market. In addition, if the dimethyl ether is manufactured within or close to the relevant fuels market location, and the natural gas available for use as a feed for making dimethyl ether in that location has been transported there as LNG or by pipeline, the natural gas within that market location may also be too expensive to economically convert the gas to dimethyl ether in that market location for use as a fuel since a significant amount, such as about 30%, of the natural gas is used for process fuel; that is, only 70% of the gas is utilized to make dimethyl ether. In many cases it would be more economical to produce the dimethyl ether at or close to the area where the natural gas is produced. However, as mentioned, transport of the resulting dimethyl ether to a distant market in those cases is a practical problem.

In addition to dimethyl ether, the manufacture of other compounds, such as olefins, paraffins and aromatic hydrocarbons, by the known methanol-to-olefins ("MTO"), methanol-to-gasoline ("MTG"), or by Fischer-Tropsch ("FT") type processes are increasingly becoming important, particularly with respect to conversion of remote carbonaceous feedstocks, such as biomass, coal and natural gas, to liquid fuels. Such processes are described for example in U.S. Pat. Nos. 3,928,483; 5,177,114 and 6,743,829, the teachings of which are incorporated herein by reference. The same transportation concerns mentioned previously for the manufacture of dimethyl ether from remotely located carbonaceous feedstocks would also apply to the manufacture and use of these other synthetic products for fuels applications.

U.S. Pat. No. 6,632,971 discloses a process for converting natural gas to methanol in liquid form at a remote natural gas production site and transporting the methanol by truck, tanker, supertanker, and pipeline to a refinery where the methanol is converted to fuel products or petrochemicals. Such transportation of liquid methanol has its drawbacks, such as described previously for dimethyl ether, and particularly with respect to use of natural gas resources remotely located in inland areas. Further, methanol can be corrosive and more difficult to handle. The patentees of the '971 patent also state in a comparative example that production of ethylene and propylene at the production site for the natural gas feed is not desired as those products cannot be shipped economically.

U.S. Pat. No. 6,449,961 discloses a method for transportation of light hydrocarbons by compressing them into a so-called "dense phase" state which is said to enable the hydrocarbons to be shipped via a transport vessel, i.e., a ship. The relevant teachings of U.S. Pat. No. 6,449,961 are incorporated herein by reference. While such method is said to reduce the size of cooling systems associated with current transportation technologies, the method relies upon transportation vessels, such as ships, rail cars or trucks, which are not always reliable and are still subject to weather concerns.

In some cases natural gas, which may include natural gas liquids or NGLs therein, produced from a subterranean reservoir, is sent via pipeline in a dense phase state in order to increase pipeline capacity. One such system is the Central Area Transmission System (CATS) wherein natural gas produced from various locations in and around the North Sea is collected and conveyed by pipeline in a dense phase state to natural gas processing facilities in the UK. Another example is the Alliance natural gas pipeline system located in Canada.

As can be seen, it would be desirable to develop alternatives for transport of such synthetic products, such as dimethyl ether and hydrocarbons produced by a MTO, MTG, or FT hydrocarbon synthesis. Such alternatives could make such remote carbonaceous feedstocks, such as coal, biomass, or natural gas, and the resulting synthetic products produced therefrom, a more economical and commercially attractive energy resource from the perspective of both energy producers and consumers.

SUMMARY OF THE INVENTION

The foregoing objectives may be attained by the present invention, which in one aspect relates to a method for transporting a composition comprised of at least one synthetic product capable of being placed in a dense phase state and derived from a carbonaceous feed, and optionally combined therewith a light hydrocarbon component produced from a subterranean formation. The method comprises:

(a) providing the composition in a dense phase state; and (b) transporting the composition from a first location to a second location within a pipeline under conditions such that the dense phase state is maintained therein.

In embodiments, the invention is directed to a method for transporting a blended composition comprised of synthetic products and natural gas produced from a subterranean formation. The method comprises:

(a) mixing the synthetic hydrocarbon and the natural gas under conditions sufficient to form a dense phase state and thereby obtain a blended composition in the dense phase state;

(b) introducing the blended composition into a pipeline in a first location;

(c) transporting the blended composition within the pipeline under conditions such that the blended composition is maintained in the dense phase from the first location to a delivery point; and (d) discharging at least a portion of the blended composition from the pipeline at the delivery point.

In embodiments, after discharging the blended composition from the pipeline, the method further comprises the following steps:

(e) converting the blended composition into a state that is not a dense phase state; and (f) separating the synthetic product from the blended composition.

In another aspect, the invention relates to a method for monetizing a carbonaceous feed located at a first location remote from at least one distant market location. The method comprises:

(a) converting the carbonaceous feed to at least one synthetic product capable of being placed in a dense phase state;

(b) providing a composition in a dense phase state comprised of the at least one synthetic product, and optionally a light hydrocarbon component produced from a subterranean formation; and (c) transporting the composition within a pipeline from the first location to the at least one distant market location under conditions such that the dense phase state of the composition is maintained therein.

In embodiments, after discharging the composition from the pipeline, the method further comprises the following steps:

(d) converting the composition into a state that is not a dense phase state; and (e) separating the at least one synthetic product from the composition.

In further embodiments, after separation of the at least one synthetic product from the composition, the synthetic product may be converted into other products, such as lower alcohols, ethers, olefins, gasoline range products, and hydrogen as described more fully hereinafter.

In another aspect, the invention relates to a method for monetizing natural gas located in a subterranean formation at a first location remote from at least one distant market location. The method comprises:

(a) converting a first portion the natural gas to dimethyl ether at the first location;

(b) providing a blended composition in a dense phase state comprised of the dimethyl ether and a second portion of the natural gas;

(c) transporting the blended composition within a pipeline from the first location to the at least one distant market location under conditions such that the dense phase of the blended composition is maintained therein;

(d) discharging at least a portion of the blended composition from the pipeline at the at least one distant market location;

(e) converting the blended composition into a state that is not a dense phase state; and (f) separating the blended composition into dimethyl ether and natural gas.

In embodiments, the resulting dimethyl ether may be further processed at the distant market location into other products, such as methanol (and other petrochemicals produced therefrom), olefins, hydrogen, and gasoline range products as more fully described hereinafter. Alternatively, the dimethyl ether may be processed into such other synthetic products, like olefins, prior to being transported in the pipeline, and thereafter those products may transported in the pipeline with the natural gas in the dense phase to such distant markets.

As can be seen, the present invention in embodiments allows for economical transport of added-value synthetic products, such as methanol and dimethyl ether, and other synthetic products produced at a production site for the natural gas via a pipeline that supplies distant markets with natural gas produced at such site.

DETAILED DESCRIPTION OF THE INVENTION

Figure 1:
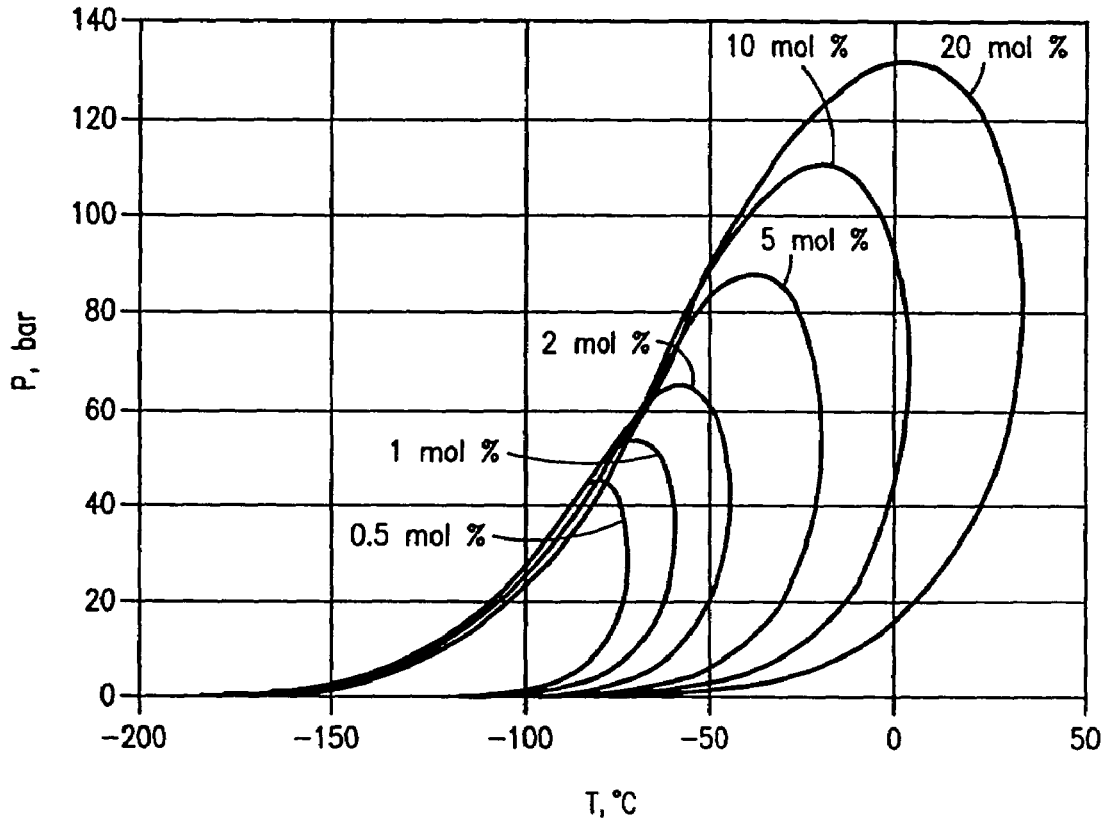
FIG. 1 is a phase diagram for blends of dimethyl ether and methane wherein the dimethyl ether is present in amounts of from 0.5 to 20 mol % based on the total composition.

According to the present invention, synthetic products prepared for example by an MTO, MTG, or Fischer-Tropsch synthesis as described hereinafter, such as light aliphatic hydrocarbons and oxygen-containing compounds like lower molecular weight alcohols, i.e., methanol, and lower molecular weight ethers, i.e., dimethyl ether, that are derived from natural gas or other carbonaceous feedstocks, are transported via pipeline as a supercritical fluid in the so-called "dense phase" state. A "synthetic product" as used herein means an oxygen-containing compound such as lower molecular weight alcohols, i.e., $C_1$ to $C_4$ alcohols, or lower molecular weight ethers, i.e., $C_2$ to $C_8$ ethers, obtained by chemical conversion of a carbonaceous feedstock, such as natural gas, coal, or biomass, or a light $C_2$ to $C_5$ hydrocarbon obtained by chemical conversion of a carbonaceous feedstock, such as natural gas, coal, or biomass, by a FT hydrocarbon synthesis as described hereinafter, or light $C_2$ to $C_5$ olefins and/or paraffins derived from methanol or other lower molecular weight alcohols and/or lower molecular weight ethers, such as dimethyl ether, by a MTO synthesis as described hereinafter. Advantageously, the synthetic products can be derived at a remote location where a relatively inexpensive carbonaceous feedstock, such as coal, natural gas, or biomass, is located, and thereafter transported within a pipeline in a dense phase state to a distant market for such synthetic products. The synthetic products can be transported neat, or in embodiments mixed or otherwise blended with light hydrocarbons, such as methane and NGLs (natural gas), produced from a subterranean formation into a blended composition, that is in turn transported in the so-called dense phase state. In embodiments, the synthetic products can be transported in such manner and later at a distant market location discharged from the pipeline, converted into a gaseous state, i.e., by reduction of temperature and/or pressure to below their critical values, and thereafter used or otherwise converted to other value-added products.

In general, a dense phase state can be obtained by compressing a gaseous composition to high pressures, typically above 5 Mpa (50 bar), to transport the gas in a modified state that permits a very low compressibility factor at or near ambient temperatures. The conditions of transport, i.e. pressure and temperature, may be such that the mixture is in embodiments carried at a temperature below the critical temperature, but above the critical pressure in which case the mixture is transported in the so-called dense phase. In any case, the conditions of temperature and pressure should be sufficient to result in a dense phase state during transport in the pipeline. Those skilled in the art can appreciate that for many compositions, be it a pure compound or mixture of compounds, there will be an area on a phase diagram for that composition that defines the dense phase state. Such phase diagrams may be readily determined by those skilled in the art using well known analytical procedures and standard calculations. A dense phase state is in general known in the art, as is recognized by U.S. Pat. No. 6,449,961, previously incorporated by reference, and also Paul J. Openshaw and Elizabeth F. Rhodes in the paper entitled "Gas purification in the dense phase at the CATS terminal" presented at the XIV Gas International Conference held in Caracas, Venezuela in May 2000. In the dense phase state, the composition exhibits properties closer to that of a liquid rather than a gas.

Attached as FIG. 1 is a phase diagram for various blends of dimethyl ether in methane, wherein the dimethyl ether is present in an amount of from 0.5 to 20 mol % in terms of the total composition, which curves can be readily determined by those skilled in the art from the known critical properties of dimethyl ether and methane. For example, the critical properties for dimethyl ether are listed in Table I.

TABLE I

| Critical Properties for Dimethyl Ether | | | | | |
|---|---|---|---|---|---|
| Tb (° K) | MW | SG | Tc (deg. K) | Pc (bar) | Omega |
| 248.3 | 46.069 | 0.667 | 400 | 52.4 | 0.2 |

Tb is the boiling point at atmospheric pressure in degrees Kelvin.
MW is molecular weight in grams/mole.
SG is the specific gravity in grams/milliliter.
Tc is the critical temperature in degrees Kelvin.
Pc is the critical pressure in bar.
Omega is the accentric factor.

Figure 2:
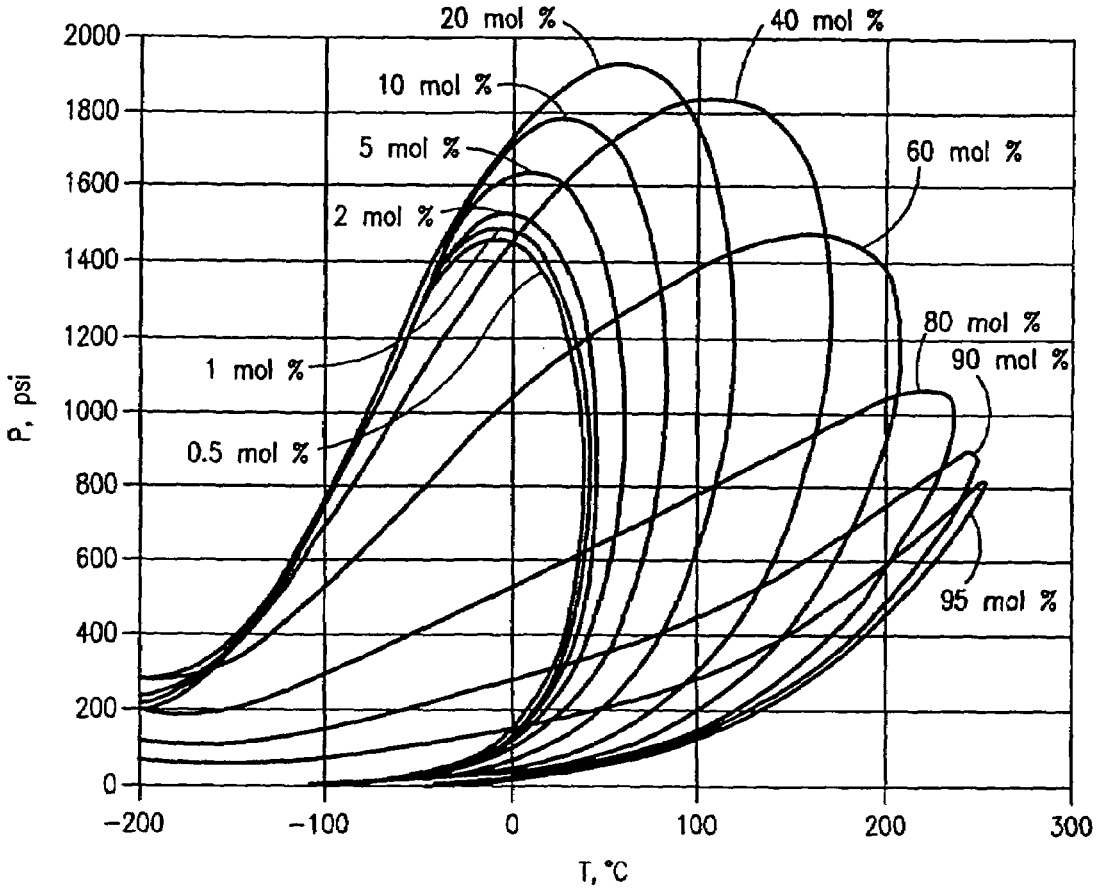
FIG. 2 is a phase diagram for blends of dimethyl ether and a natural gas composition described in connection with the example provided hereinafter, wherein the dimethyl ether is present in amounts of from 0.5 to 95 mol % based on the total composition.

Attached as FIG. 2 is a phase diagram for various blends of dimethyl ether and a natural gas employed in the example that follows hereinafter.

In general, a dense phase can be obtained by operation outside of the "two-phase" portion of the curve for a mixture as depicted in FIGS. 1 and 2, i.e., outside the envelope defined by the curve and primarily in the upper portion of the diagram, such as for FIG. 1 at a pressure above about 1,595 psi (110 bar) for a mixture of methane with 10 mol % dimethyl ether therein. The temperature associated with operation in the dense phase state can vary both above and below the critical temperature for the composition at issue. As is evident to those skilled in the art, the ambient temperatures anticipated over the length of the pipeline may have some bearing on the amount of dimethyl ether (and/or in other embodiments other desired synthetic products, using a similar phase diagram) than can be transported at the given operating pressures for the pipeline.

Where the synthetic hydrocarbon is to be blended with light hydrocarbon gas, i.e., natural gas, for transport in a pipeline in the dense phase, the upper limit for the amount of synthetic hydrocarbon added in the composition to be transported is preferably that which allows the resulting blend to be maintained in the dense phase for the pressures and temperatures at which the composition is to be conveyed, typically those conditions being specified for the pipeline in question. Generally, the pipeline pressure can be set to maintain the composition in the dense phase at a desired delivery location, such as a pressure that is within the dense phase area of the phase diagram for a composition at issue plus such as a factor of 10% above the critical pressure. This can preclude undesired excursions out of the dense phase region, i.e., into a liquid state, gaseous state, or two-phase region (liquid and gaseous states) of the applicable phase diagram. In the case of the 10 mol % dimethyl ether and methane composition as mentioned above, such pressure would be about 1760 psi (121.3 bar) or higher. In addition, it may be desirable to have recompression stations located in the pipeline system at issue to periodically increase pipeline pressure so that the composition is maintained in a dense phase state. It is possible, but less desirable, to have a portion of the flow in the pipeline be in the liquid state.

Where the synthetic products are to be mixed with natural gas, in many instances the natural gas is produced from a subterranean formation at substantial wellhead pressures, such as 3000 psig (206.8 bar) and higher. As a result, in those instances the synthetic products to be mixed may be pressurized or compressed to the desired pressure and then mixed with the natural gas to provide a blended composition in the dense phase state that can be transported by pipeline. On the other hand, some natural gas fields do not produce gas at such high pressures, and thus, it may be necessary to also compress the natural gas and synthetic products to obtain a blended composition in a dense phase state.

In embodiments, this invention relates generally to transporting synthetic products, such as dimethyl ether, olefins, FT-derived hydrocarbon products and other synthetic products, provided the synthetic products are capable of being placed into a dense phase state. Such products can be mixed with or without natural gas, or other light virgin hydrocarbons produced from a subterranean formation, in the dense phase state within a pipeline. By "light hydrocarbons", it is meant a mixture comprised substantially of $C_1$ to $C_5$ hydrocarbons which may be in a gaseous state at normal atmospheric conditions of temperature and pressure. As used herein, the term "virgin" in reference to hydrocarbons means hydrocarbons that produced from a subterranean formation.

At the terminal end of a transportation pipeline, or even at one or more intermediate locations along the pipeline as dictated by market needs, the composition being transported in the pipeline in the dense phase state comprising such synthetic products, either neat (high purity) or as blends with or without low molecular weight virgin light hydrocarbons, can be discharged from the pipeline. In some embodiments, the discharge point or delivery location in a distant market is an extended distance from the location where the carbonaceous feed source is located, such as at least 50 miles and some cases as much as 3,000 miles or greater. After discharge, the transport composition can be converted out of the dense phase state into a state that is not the dense phase, such as a gaseous phase, by adjustment, for example, of the pressure so as to place the composition outside of the dense phase region of the phase diagram for the composition being transported. Thereafter, the individual components of such composition, if it is a mixture, can be separated by any known separation technology such as, but not limited to, fractionation or molecular sieves. The resulting product streams after separation can then be used as transportation fuels, liquefied petroleum gas ("LPG"), home/domestic heating and cooking gas, or fuel for power generation. After fractionation, the dimethyl ether could also be taken as a cut with some NGL range material therein and used as a diesel fuel and/or as fuel gas for heating, cooking or other uses. Also, an NGL cut could be taken with dimethyl ether therein to enhance the combustion properties for various fuel uses.

In addition, lower molecular weight ethers, such as dimethyl ether, can be readily converted to methanol or other lower molecular weight alcohols at the delivery location by methods known in the art. The resulting methanol or other lower alcohols can then be converted to other products; light olefins by a MTO process or products boiling in the gasoline range, such as a gasoline blend stock, by a MTG process, as needed by the particular market. This can be advantageous, in that methanol or other lower molecular weight alcohols may be more difficult to transport than dimethyl ether.

Alternatively, the dimethyl ether or other synthetic products can be converted into molecular hydrogen by well known reforming methods at the delivery point from the pipeline, if that type of product is desired in the local market. For example, the hydrogen could be used as a fuel in a fuel cell, illustrated for example in U.S. Pat. No. 6,821,501, or as fuel to a conventional power plant, such as a combined cycle power plant, to produce electrical power.

The amount of synthetic product transported, such as dimethyl ether, can also vary over time, depending on the needs of the market or seasonal demands. Initially, the synthetic product could be transported neat, and then later blended with virgin light hydrocarbons produced from a subterranean formation, such as natural gas and NGLs, to a 50/50 molar blend, or any desired blend as shown in FIGS. 1 and 2. The amount of synthetic products blended therein can be altered as desired. Where the pipeline used for transport of the synthetic products will also be used to transport natural gas, the amount of synthetic products blended with the natural gas can be less than 50 mol %, and also less than 20 mol %, and even less than 10 mol %, depending on anticipated pipeline conditions.

The natural gas feed employed may be any natural gas or light hydrocarbon-containing gas, such as that obtained from natural gas, coal, shale oil, residua or combinations thereof, which can be used as a fuel gas.

Natural gas is a preferred carbonaceous feed. The natural gas contemplated for use herein generally comprises at least 50 mole percent methane, preferably at least 75 mole percent methane, and more preferably at least 90 mole percent methane. The balance of the natural gas feed can generally comprise other combustible hydrocarbons such as, but not limited to, lesser amounts of ethane, propane, butane, pentane, and other higher boiling hydrocarbons, and non-combustible components such as carbon dioxide, hydrogen sulfide, helium and nitrogen, which are produced with the methane from a subterranean formation.

The presence of an excessive amount of heavier hydrocarbons such as ethane, propane, butane, pentane, and hydrocarbons boiling at a boiling point above pentane, which may be present in some natural gas feeds can optionally be reduced through gas-liquid separation steps, particularly in the event such hydrocarbons have greater value for use outside the production of a fuel composition, or synthetic products as mentioned below. Hydrocarbons boiling at a temperature above the boiling point of hexane are generally directed to crude oil. Hydrocarbons boiling substantially at a temperature above the boiling point of ethane and below the boiling point of pentane or hexane are typically removed to some extent and are sometimes referred to as natural gas liquids or "NGLs". For example, excessive amounts of these heavier hydrocarbons are also typically removed from natural gas.

For most markets, it is also desirable to minimize the presence of non-combustibles and contaminants in the gas, such as carbon dioxide, helium and nitrogen and hydrogen sulfide. Depending on the quality of a given natural gas reservoir (which may contain as much as 50% to 70% carbon dioxide), the natural gas may be pre-treated at a natural gas plant for pre-removal of the above components or the gas may be conveyed directly to a plant facility for pre-processing prior to manufacture of synthetic products.

Pretreatment steps generally begin with steps commonly identified and known in connection with LNG production or FT hydrocarbon synthesis, including, but not limited to, removal of acid gases (such as $H_2S$ and $CO_2$), mercaptans, mercury and moisture from the natural gas feed stream. Acid gases and mercaptans are commonly removed via a sorption process employing an aqueous amine-containing solution or other types of known physical or chemical solvents.

An inhibited amine solution can be used to selectively remove the $CO_2$ in the natural gas stream, but not $H_2S$. The $H_2S$ can then be removed in a subsequent step. Also, it is desirable to employ a guard bed (such as a ZnO guard bed) for removal of any remaining, residual sulfur-containing compounds that may be present in the $CO_2$ rich stream prior to feeding the stream to points within a hydrocarbon synthesis process, such as upstream of a pre-reforming reactor or reforming reactor. Such reactors typically employ nickel catalysts which can be susceptible to poisoning by sulfur-containing compounds, such as $H_2S$.

As disclosed in U.S. patent application Ser. No. 10/805,982 filed on Mar. 22, 2004, incorporated herein by reference in its entirety, it may also be desirable to prepare a $CO_2$ rich stream for use in the manufacture of methanol, dimethyl ether, and light synthetic products from the $CO_2$ contaminant separated from a produced natural gas, wherein the $CO_2$ rich stream has been treated as described above to have only minimal amounts of contaminants, such as $H_2S$, mercaptans, and other sulfur-containing compounds therein.

The synthetic products can be prepared by any known method, and in embodiments particularly by an indirect synthesis process, wherein the natural gas feed stream is first passed to a synthesis gas plant for conversion of the feed stream to synthesis gas, and thereafter the synthesis gas is converted for example to oxygenates, such as methanol and other lower molecular weight alcohols or dimethyl ether and other lower molecular weight ethers, which may then be converted to other products, such as olefins, paraffins or products boiling in the gasoline range. Alternatively, the synthesis gas may be converted directly to hydrocarbons via Fischer-Tropsch synthesis.

The synthesis gas comprised of hydrogen and carbon oxides, i.e., carbon monoxide and carbon dioxide, employed may be generated by any available technology known in the art. Various coal and biomass gasification methods to produce synthesis gas are well known in the art. Suitable natural gas reforming steps generally include steam reforming, autothermal reforming, gas heated reforming and partial oxidation reforming.

Steam methane reforming generally contemplates reacting steam and natural gas at high temperatures and moderate pressures over a reduced nickel-containing catalyst so as to produce synthesis gas. Generally, the reaction temperature, measured at the reactor outlet, is in excess of 500° F. (260° C.), preferably ranging from about 1000° F. (537.8° C.) to about 2000° F. (1093.3° C.), and more preferably from about 1500° F. (815.6° C.) to about 1900° F. (1037.8° C.) is employed. The reaction pressure is generally maintained at between 50 psig (3.4 barg) and 1000 psig (68.9 barg), preferably at between 150 psig (10.3 barg) and 800 psig (55.2 barg), and more preferably at between 250 psig (17.2 barg) and 600 psig (41.4 barg).

Autothermal reforming generally contemplates processing steam, natural gas and oxygen through a specialized burner for combusting a portion of the natural gas. Partial combustion of the natural gas provides the heat necessary to conduct synthesis gas reforming over a reduced nickel-containing catalyst bed located in proximity to the burner. Generally, a reaction temperature, measured at the reactor outlet, in excess of 1000° F. (537.8° C.), preferably ranging from about 1500° F. (815.6° C.) to about 2000° F. (1093.3° C.), and more preferably from about 1800° F. (982.2° C.) to about 1900° F. (1037.8° C.) is employed. The reaction pressure is generally maintained at between 50 psig (3.4 barg) and 1000 psig (68.9 barg), preferably at between 150 psig (10.3 barg) and 800 psig (55.2 barg), and more preferably at between 250 psig (17.2 barg) and 600 psig (41.4 barg).

Partial oxidation reforming generally contemplates processing steam, natural gas and oxygen through a specialized burner for combusting a substantial portion of the natural gas to synthesis gas in the absence of a catalyst. A reaction temperature, measured at the reactor outlet, in excess of 1500° F. (815.6° C.), preferably ranging from about 2000° F. (1093.3° C.) to about 6000° F. (3315.6° C.), and more preferably from about 2000° F. 1093.3° C.) to about 4000° F. (2204.4° C.) is employed. The reaction pressure is generally maintained at between 250 psig (17.2 barg) and 1500 psig (103.4 barg), preferably at between 300 psig (20.7 barg) and 1200 psig (82.7 barg), and more preferably at between 300 psig (20.7 barg) and 800 psig (55.2 barg).

The molar ratio of hydrogen, carbon monoxide, and carbon dioxide is generally customized so as to most efficiently produce the downstream products of interest. For FT products, the hydrogen to carbon monoxide molar ratio will generally range from about 1.5 to about 2.5 and more preferably from about 2.0 to about 2.1. For methanol, dimethyl ether or dimethoxymethane production, the hydrogen minus carbon dioxide to carbon monoxide plus carbon dioxide molar ratio (mentioned below) will generally range from about 1.5 to about 2.5 and more preferably from about 2.0 to about 2.1, but can vary.

In the practice of the invention, it is advantageous in many cases to convert the synthesis gas into lower molecular weight alcohols, such as a $C_1$ to $C_4$ alcohols with one or more hydroxyl groups, for example methanol, ethanol, n-propanol, iso-propanol, n-butanol, and iso-butanol, and preferably $C_1$ to $C_3$ alcohols, which alcohols can be converted in a subsequent step to lower molecular weight ethers or light olefins as more fully described hereinbelow. In embodiments, it is preferred to convert the synthesis gas to methanol.

In general, the reaction of synthesis gas to oxygen-containing organic compounds, such as lower molecular weight alcohols like methanol, is exothermic, can be conducted in the gas phase or liquid phase, and is favored by low temperature and high pressure over a heterogeneous catalyst. The methanol synthesis reactions employed on an industrial scale can be illustrated by the following reversible chemical equations:

$$CO+2H_2 \leftrightarrows CH_3OH$$

or $$CO_2+3H_2 \leftrightarrows CH_3OH+H_2O$$

The catalyst formulations employed typically include copper oxide (60-70%), zinc oxide (20-30%) and alumina (5-15%). Chapter 3 of *Methanol Production and Use*, edited by Wu-Hsun Cheng and Harold H. Kung, Marcel Dekker, Inc., New York, 1994, pages 51-73, provides a summary of conventional methanol production technology with respect to catalyst, reactors, typical yields, and operating conditions.

Methanol is generally produced in what is known as a "synthesis loop" which incorporates the generation of the synthesis gas. Although synthesis gas for methanol production may also be produced from coal gasification and partial oxidation, the primary route employed currently by industry is via the steam reforming of natural gas. The steam reformer is essentially a large process furnace in which catalyst-filled tubes are heated externally by direct firing to provide the necessary heat for the following reversible reaction, known as the water-gas shift reaction to take place:

$$C_nH_{2n+2}+nH_2O \leftrightarrows nCO+(2n+1)H_2$$

wherein n is the number of carbon atoms per molecule of hydrocarbon.

Generally, the production of oxygenates, primarily methanol, takes place as a combination of process steps. The process steps can include: synthesis gas preparation, methanol synthesis, and if needed, methanol distillation.

In the synthesis gas preparation step, the hydrocarbon gas feedstock is purified to remove sulfur and other potential catalyst poisons prior to being converted into synthesis gas. The conversion to synthesis gas generally takes place at high temperatures over a nickel-containing catalyst to produce a synthesis gas containing a combination of hydrogen, carbon monoxide, and carbon dioxide. Typically, the pressure at which synthesis gas is produced ranges from about 290 psi (20 bar) to about 1088 psi (75 bar) and the temperature at which the synthesis gas exits the reformer ranges from about 1292° F. (700° C.) to 2012° F. (1100° C.). The synthesis gas contains a stoichiometric molar ratio of hydrogen to carbon oxide, generally expressed as follows:

$$S_n=[H_2-CO_2]/[CO+CO_2]$$

which is generally from 2 to 3 and more typically from about 2.0 to 2.3. The synthesis gas is subsequently compressed to a methanol synthesis pressure as described below. In the methanol synthesis step, the compressed synthesis gas is converted to methanol, water, and minor amounts of by-products.

As disclosed in U.S. Pat. No. 3,326,956, low-pressure methanol synthesis is based on a copper oxide-zinc oxide-alumina catalyst that typically operates at a nominal pressure of 5-10 MPa (50-100 bar) and temperatures ranging from about 150° C. (302° F.) to about 450° C. (842° F.) over a variety of commercially available catalysts, including $CuO/ZnO/Al_2O_3$, $CuO/ZnO/Cr_2O_3$, $ZnO/Cr_2O_3$, Fe, Co, Ni, Ru, Os, Pt, and Pd. Catalysts based on ZnO for the production of methanol and dimethyl ether are preferred. Methanol yields from copper-based catalysts are generally over 99.5% of the combined $CO+CO_2$ present as methanol in the crude product stream. Water is a by-product of the conversion of the synthesis gas to oxygenates. Methanol and other oxygenates produced in the above manner are herein further referred to as an oxygenate feedstock.

The methanol product can be readily converted to dimethyl ether by any known process, such as that disclosed in U.S. Pat. Nos. 4,417,000 and 5,218,003, and EP Patent Publications 324 475 and 0 409 086, previously mentioned and incorporated by reference herein. In general, dimethyl ether is prepared by dehydrating methanol over an acidic catalyst, such as a dehydration catalyst selected from alumina, silica-alumina, zeolites (for example ZSM-5), solid acids (for example boric acid), solid acid ion exchange resins (for example perflurorinated sulfonic acid), and mixtures thereof, to produce dimethyl ether and water. The synthesis gas may also be converted into dimethyl ether, or mixture of dimethyl ether and methanol, by a one-step process using a dual catalyst system comprised of a methanol synthesis catalyst and dehydration catalyst.

Alternatively, the methanol or lower molecular weight alcohols can be then readily converted to olefins by known MTO synthesis processes. Molecular sieves such as the microporous crystalline zeolite and non-zeolitic catalysts, particularly silicoaluminophosphates (SAPO), are known to promote the conversion of oxygenates, such as methanol, to olefins and other hydrocarbon mixtures. Numerous patents describe this type of process which also employ various types of catalysts, see, e.g., U.S. Pat. Nos. 3,928,483; 4,025,575; 4,252,479; 4,496,786; 4,547,616; 4,677,243; 4,843,183; 4,499,314; 4,447,669; 5,095,163; 5,126,308; 4,973,792; and 4,861,938, the teachings of which are incorporated herein by reference. Also useful is the process disclosed in U.S. Pat. No. 6,534,692, which converts methanol with increased selectivity to ethylene and propylene using a metalloaluminophosphate molecular sieve catalyst. Such processes are referred to in the art as "MTO" (methanol-to-olefin) type processes, which typically result in conversion of low molecular weight alcohols, such as methanol, to light $C_2$ to $C_5$ olefins, such as ethylene, propylene and mixtures thereof.

The above-described oxygenate conversion process may also be generally conducted in the presence of one or more diluents which may be present in the oxygenate feed in an amount between about 1 and about 99 molar percent, based on the total number of moles of all feed and diluent components fed to the reaction zone (or catalyst). Diluents include—but are not limited to—helium, argon, nitrogen, carbon monoxide, carbon dioxide, hydrogen, water, paraffins, hydrocarbons (such as methane and the like), aromatic compounds, or mixtures thereof. U.S. Pat. Nos. 4,861,938 and 4,677,242 particularly emphasize the use of a diluent combined with the feed to the reaction zone to maintain sufficient catalyst selectivity toward the production of light olefin products, particularly ethylene. The foregoing U.S. Patents are incorporated herein by reference in their entirety.

If desired, the light olefins obtained as described above may be hydrogenated by well-known methods and thereby converted into light paraffinic hydrocarbons. Such methods and catalysts therefor are described in U.S. Pat. No. 4,075,251, the teachings of which are incorporated herein by reference. Catalysts include various transition metal catalysts as mentioned in the foregoing U.S. Patent, and are commercially available. In general, olefins may be converted to paraffins by contact with the foregoing catalysts and hydrogen or hydrogen-containing gases at temperatures ranging from about 0° F. (−17.8° C.) to about 1000° F. (537.8° C.), more typically temperatures ranging from about 100° F. (37.8° C.) to about 500° F. (260° C.). The reactions can be conducted at lower than atmospheric pressures or greater than atmospheric pressures, but generally pressures ranging from as low as about 1 atmosphere (1 bar) to about 500 atmospheres (506.6 bar), and specifically from about 1 atmosphere (1 bar) to about 50 atmospheres (50.7 bar) are suitable. The catalysts and feedstock can be contacted as slurries or fixed beds, movable beds and fluidized beds, in liquid phase or vapor phase, in batch, continuous or staged operations.

The low molecular weight alcohols, including methanol, can be also readily converted to gasoline range products by known MTG synthesis processes, such as those disclosed in U.S. Pat. Nos. 3,894,102; 3,894,106; 3,894,107; 3,928,483 and 5,117,114, the teachings of which are incorporated herein by reference.

In general, the low molecular weight alcohols as previously described may be converted in a staged process to such gasoline range products, In an initial stage, the lower molecular weight alcohols may be converted to low molecular weight ethers, i.e., $C_2$ to $C_8$ ethers, and preferably $C_2$ to $C_6$ ethers, such as dimethyl ether, diethyl ether, di-n-propyl ether, diisopropyl ether, methyl ethyl ether, methyl n-propyl ether, methyl isopropyl ether, ethyl n-propyl ether, ethyl isopropyl ether, n-propyl isopropyl ether, and mixtures thereof. Such conversion may be conducted by contacting the alcohols with a condensation catalyst at temperatures of 250° F. to 900° F. and pressures from about atmospheric to 500 psig as disclosed in U.S. Pat. No. 3,928,483, previously incorporated by reference. Suitable condensation catalysts include liquid acids such as sulfuric and phosphoric acid, solid inorganic acids and organic acidic catalysts such as phosphoric acid supported on kieselguhr, high surface area silica-alumina, acidic aluminas, acid treated clays, bauxites, and sulfonated polystyrene-based ion exchange resins. In a subsequent stage, the lower molecular weight ethers may be converted to gasoline range products by contacting the ethers with a zeolite catalyst at a temperature of from 500° F. to 1000° F. and pressure from atmospheric to 3000 psig, as is also described U.S. Pat. No. 3,928,483. Suitable zeolite catalysts include crystalline aluminosilicate zeolites having a silica to alumina ratio of at least 12 and constraint index of 1 to 12, as more fully described in the foregoing patent as well as U.S. Pat. Nos. 3,894,106 and 3,894,107, also incorporated herein by reference herein in their entirety. Where the feed is a dimethyl ether and methanol mixture at a weight ratio of 3 to 1, the resulting gasoline range hydrocarbon products include various amounts of paraffinic, olefinic and aromatic hydrocarbons.

In addition to oxygenates, the carbonaceous feed and particularly a natural gas feed can also be converted into synthetic products, such as paraffins and olefins, via well-known Fischer-Tropsch technology as illustrated generally by U.S. Pat. Nos. 6,248,794; 6,774,148 and 6,743,962, the teachings of which are incorporated by reference herein in their entirety.

Fischer-Tropsch synthesis in general exothermically reacts synthesis gas, i.e., hydrogen and carbon monoxide, over either an iron or cobalt based catalyst to produce a range of synthetic hydrocarbon products. The specific hydrocarbon product distribution depends strongly on both the catalyst and the reactor temperature. Generally, the higher the reactor temperature, the shorter the average hydrocarbon product chain length. Reactor temperatures are generally in excess of 350° F. (176.7° C.), generally from about 350° F. (176.7° C.) to about 650° F. (343.3° C.), and more typically from about 400° F. (204.4° C.) to about 500° F. (260° C.). The reaction pressure is generally maintained at between 200 psig (13.8 bar) and 600 psig (41.4 bar), and is typically from 300 psig (20.7 bar) and 500 psig (34.5 bar). The Fischer-Tropsch reaction can be conducted in any of several known reaction devices such as, but not limited to, a slurry reactor, an ebullated bed reactor, a fluidized bed reactor, a circulating fluidized bed reactor, and a multi-tubular fixed bed reactor.

The Fischer-Tropsch reaction can generate significant amounts of light synthetic products, either paraffins or olefins, which are usually not as desirable in and of themselves, as such Fischer-Tropsch processes are typically directed toward making higher molecular weight materials, i.e., distillate fuels. However, such light $C_2$ to $C_5$ synthetic hydrocarbon products can be used as a synthetic hydrocarbon component ("synthetic LPG") according to the invention. In embodiments, the synthetic hydrocarbon component may comprise a blend of $C_2$ to $C_5$ olefins, paraffins, or mixtures thereof in any combination.

In addition, methanol can be readily converted into acetic acid and other acetyl derivatives by known methods, such as carbonylation, the reaction of methanol with carbon monoxide (CO) as is described in U.S. Pat. No. 6,472,558, the teachings of which are incorporated herein by reference.

The following example will serve to further illustrate the invention and some advantages thereof.

EXAMPLE

Figure 3:
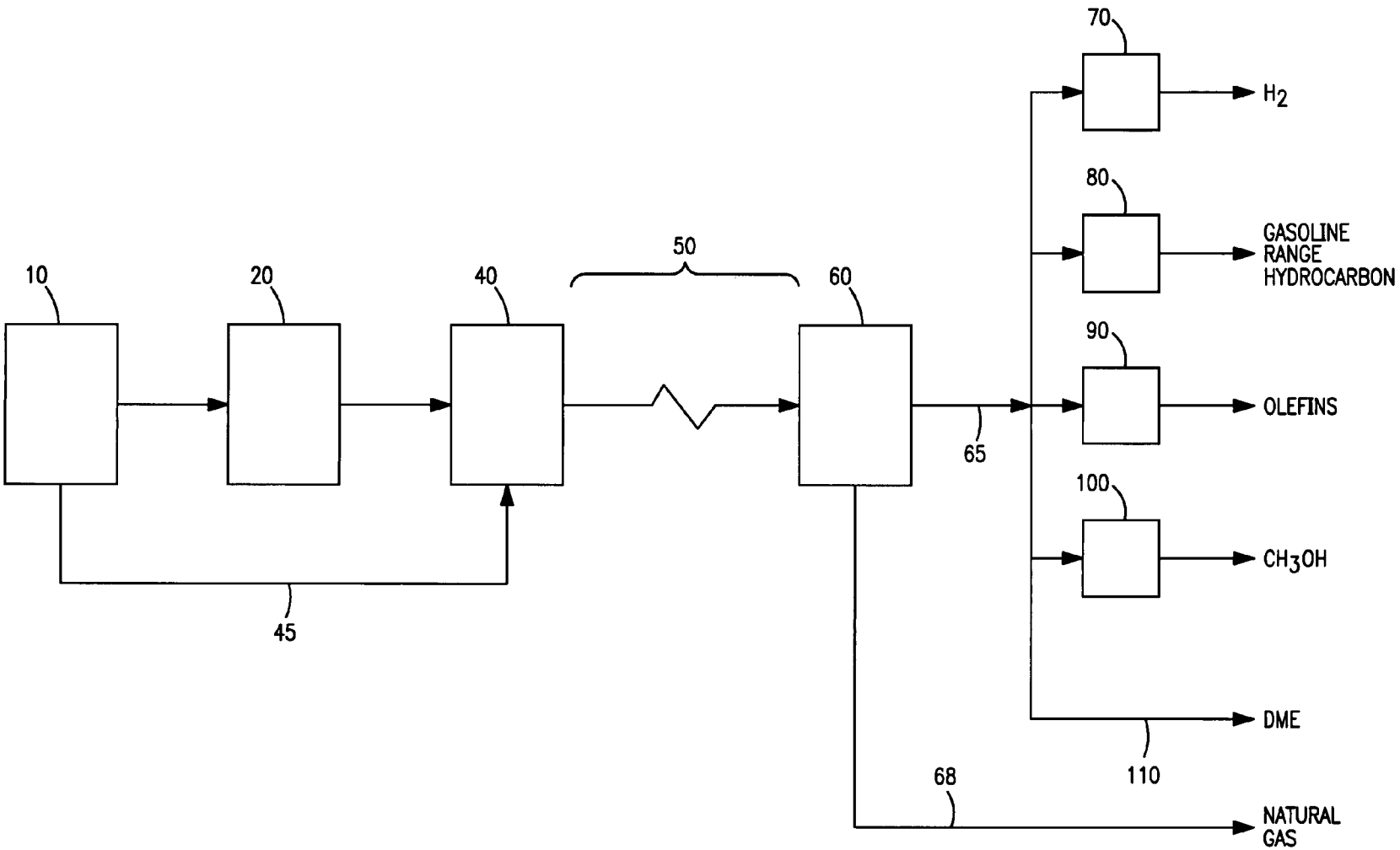
FIG. 3 is a process flow diagram which illustrates a process for transporting dimethyl ether according to one embodiment of the invention from a site where natural gas is produced and converted into dimethyl ether. The dimethyl ether is then transported to a distant market site for the dimethyl ether, where the dimethyl ether may be sold as a fuel or as a feedstock to produce other value-added products.

Referring now to FIG. 3, a natural gas stream containing the following compounds in the mole percentages shown:

| Component | Mol % |
|---|---|
| methane | 92.0 |
| ethane | 2.4 |
| propane | 1.6 |
| iso-butane | 1.0 |
| n-butane | 1.5 |
| iso-pentane | 0.4 |
| n-pentane | 0.4 |
| Non-combustibles | 0.7 |

is produced at a production site 10 located in central Russia at a rate of about 2.5 billion $ft^3$/day (bcfd) and wellhead pressure of 2000 psi (137.9 bar). A portion of this natural gas (about 0.25 bcfd) is pre-treated to remove particulates, water, and other contaminants (not shown), and is thereafter converted at conversion site 20 to 5,000 metric tones per day of dimethyl ether. The conversion site 20 employs a process substantially as described in U.S. Pat. No. 4,417,000 to produce the dimethyl ether product at high yield.

The dimethyl ether produced at conversion site 20 is directed to a shipping terminal 40 located adjacent to conversion site 20. At shipping terminal 40, a blended composition is prepared by mixing the dimethyl ether product with another portion of the produced natural gas that is conveyed to the shipping terminal 40 from production site 10 by line 45. The amount of the natural gas employed in blending with the dimethyl ether is sufficient to produce a blended composition having about 4 mol % dimethyl ether therein. FIG. 2, previously discussed herein, illustrates the phase diagram for the above-described natural gas and various blends of dimethyl ether. In addition to being mixed, the blended composition is compressed at the shipping terminal to a pressure of 1,760 psig (121.3 barg) which places the blended composition into a dense phase state. The dimethyl ether product stream is also compressed to a pressure of 1,760 psig (121.3 barg) to facilitate the mixing of the dimethyl ether with the natural gas.

The blended composition is thereafter transported by pipeline 50 from shipping terminal 40 to a delivery terminal 60 located at a distant market location. At the pipeline pressure specified above, the temperature of the blended composition as it travels across the length of the pipeline 50 is not expected to cause the composition to enter into the two phase region for that composition as shown in FIG. 2. Over the length of pipeline 50, a number of recompression stations (not shown) are also placed to maintain the pressure within the pipeline so that the blended composition is maintained in a dense phase state. In general, it is necessary to maintain the blended composition at a pressure of greater than 1600 psig (110.3 barg) across the length of pipeline 50 in order to maintain the blended composition in the dense phase state.

At delivery terminal 60, the blended composition is discharged from pipeline 50 and the pressure is reduced to convert the blended composition from the dense phase state into a gaseous state. The dimethyl ether is then recovered from the blended composition by fractionation (not shown).

After recovery of dimethyl ether, the natural gas separated therefrom is conveyed into a local pipeline system (not shown) by line 68. The recovered dimethyl ether is conveyed by line 65 to a number of downstream operations. In unit 70, a portion of the dimethyl ether is converted by reforming into hydrogen which may then be used as fuel for a power plant generating electrical power. In unit 80, a portion of the dimethyl ether is converted into gasoline range hydrocarbons. In unit 90, a portion of the dimethyl ether is converted to olefins (ethylene and propylene). In unit 100, a portion of the dimethyl ether is converted into methanol. A portion of the recovered dimethyl ether may also be directly conveyed by line 110 to be used as fuel for many applications, such as fuel for a power plant generating electrical power.

Other embodiments and benefits of the invention will be apparent to those skilled in the art from a consideration of this specification or from practice of the invention disclosed herein. It is intended that this specification be considered as exemplary only with the true scope and spirit of the invention being indicated by the following claims.

We claim:

1. A method for monetizing a carbonaceous feed located at a first location remote from at least one distant market location, the method comprising:

(a) converting the carbonaceous feed to at least one synthetic product capable of being placed in a dense phase state;

(b) providing a composition in a dense phase state comprised of the at least one synthetic product, and a light hydrocarbon component produced from a subterranean formation;

(c) transporting the composition within a pipeline from the first location to the at least one distant market location under conditions such that the dense phase state of the composition is maintained therein;

(d) discharging at least a portion of the composition from the pipeline at the at least one distant market location;

(e) converting the composition into a state that is not a dense phase state; and (f) separating the at least one synthetic product from the composition.

2. The method of claim 1 wherein the carbonaceous feed is selected from natural gas, coal, and biomass.

3. The method of claim 1 wherein the carbonaceous feed is natural gas.

4. The method of claim 1 wherein the light hydrocarbon component comprises natural gas.

5. The method of claim 1 wherein the at least one market location is at least 50 miles from the first location.

6. The method of claim 5 wherein the at least one market location is an intermediate location between the first point and a terminal end of the pipeline.

7. The method of claim 1 wherein the separating step is conducted adjacent to the delivery point.

8. The method of claim 1 wherein the at least one synthetic product is a $C_2$ to $C_6$ ether.

9. The method of claim 8 wherein the $C_2$ to $C_6$ ether is selected from dimethyl ether, diethyl ether, di-n-propyl ether, diisopropyl ether, methyl ethyl ether, methyl n-propyl ether, methyl isopropyl ether, ethyl n-propyl ether, ethyl isopropyl ether, n-propyl isopropylether, and mixtures thereof.

10. The method of claim 1 wherein the at least one synthetic product is dimethyl ether.

11. The method of claim 1 wherein the at least one synthetic product comprises $C_2$ to $C_5$ hydrocarbons which are derived from the carbonaceous feed by a Fischer-Tropsch synthesis.

12. The method of claim 1 wherein the at least one synthetic product comprises olefins which are derived from the carbonaceous feed by an MTO-type synthesis.

13. The method of claim 1 wherein the at least one synthetic product is a $C_2$ to $C_6$ ether.

14. The method of claim 13 wherein the $C_2$ to $C_6$ ether is dimethyl ether.

15. The method of claim 13 wherein after step (f) the $C_2$ to $C_6$ ether is converted to $C_1$ to $C_3$ alcohols.

16. The method of claim 15 wherein the $C_1$ to $C_3$ alcohols are converted to olefins by a MTO-type synthesis.

17. The method of claim 13 wherein after step (f) the $C_2$ to $C_6$ ethers are converted to gasoline range products.

18. The method of claim 16 wherein the olefins comprise ethylene, propylene, or mixtures thereof.

19. The method of claim 14 wherein after step (f) the dimethyl ether is converted to methanol.

20. The method of claim 19 wherein the methanol is reacted with carbon monoxide to produce acetic acid.

21. The method of claim 14 wherein the diethyl ether is converted to hydrogen.

22. A method for monetizing a natural gas located in a subterranean formation at a first location remote from at least one distant market location, the method comprising:

(a) converting a first portion the natural gas to dimethyl ether at the first location;

(b) providing a blended composition in a dense phase state comprised of the dimethyl ether and a second portion of the natural gas;

(c) transporting the blended composition within a pipeline from the first location to the at least one distant market location under conditions such that the dense phase of the blended composition is maintained therein;

(d) discharging at least a portion of the blended composition from the pipeline at the at least one distant market location;

(e) converting the blended composition into a state that is not a dense phase state; and (f) separating the blended composition into dimethyl ether and natural gas.

23. A method for transporting a composition comprised of at least one synthetic product capable of being placed in a dense phase state and derived from a carbonaceous feed, and a light hydrocarbon component produced from a subterranean formation, the method comprising:

(a) providing the composition in a dense phase state;

(b) transporting the composition from a first location to a second location within a pipeline under conditions such that the dense phase state is maintained therein;

(c) discharging at least a portion of the composition from the pipeline at a delivery point;

(d) converting the composition into a state that is not a dense phase state; and (e) separating the at least one synthetic product from the composition.

24. The method of claim 23 wherein the first location is adjacent to a source of the carbonaceous feed.

25. The method of claim 23 wherein the carbonaceous feed is natural gas.

26. The method of claim 23 wherein the light hydrocarbon component comprises natural gas.

27. The method of claim 23 wherein the second location is adjacent to a market for the at least one synthetic product.

28. The method of claim 23 wherein the delivery point is an intermediate location between the first point and a terminal end of the pipeline.

29. The method of claim 23 wherein the separating step is conducted adjacent to the delivery point.

30. The method of claim 23 wherein the at least one synthetic product comprises $C_2$ to $C_5$ hydrocarbons which are derived from the carbonaceous feed by a Fischer-Tropsch hydrocarbon synthesis.

31. The method of claim 23 wherein the at least one synthetic product comprises olefins which are derived from the carbonaceous feed by an MTO-type synthesis.

32. The method of claim 23 wherein the at least one synthetic product is a $C_2$ to $C_6$ ether.

33. The method of claim 32 wherein the $C_2$ to $C_6$ ether is dimethyl ether.

34. The method of claim 32 wherein after step (e) the $C_2$ to $C_6$ ether is converted to $C_1$ to $C_3$ alcohols.

35. The method of claim 34 wherein the $C_1$ to $C_3$ alcohols are converted to olefins via an MTO-type synthesis.

36. The method of claim 32 wherein after step (e) the $C_2$ to $C_6$ ether is converted to gasoline range products.

37. The method of claim 33 wherein after step (e) the dimethyl ether is converted to methanol.

38. The method of claim 37 wherein the methanol is reacted with carbon monoxide to produce acetic acid.

39. The method of claim 33 wherein the dimethyl ether is converted to hydrogen.

40. The method of claim 35 wherein the olefins comprise ethylene, propylene, or mixtures thereof.

41. The method of claim 32 wherein the $C_2$ to $C_6$ ether is selected from dimethyl ether, diethyl ether, di-n-propyl ether, diisopropyl ether, methyl ethyl ether, methyl n-propyl ether, methyl isopropyl ether, ethyl n-propyl ether, ethyl isopropyl ether, n-propyl isopropyl ether, and mixtures thereof.

* * * * *